US011006725B2

(12) United States Patent
Jung et al.

(10) Patent No.: US 11,006,725 B2
(45) Date of Patent: May 18, 2021

(54) BEAD DISCHARGE PUMP CONTAINER

(71) Applicant: YONWOO CO., LTD, Incheon (KR)

(72) Inventors: Seo-Hui Jung, Incheon (KR); Sung-Woong Choi, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 16/490,721

(22) PCT Filed: Jan. 15, 2018

(86) PCT No.: PCT/KR2018/000659

§ 371 (c)(1),
(2) Date: Sep. 3, 2019

(87) PCT Pub. No.: WO2018/164370

PCT Pub. Date: Sep. 13, 2018

(65) Prior Publication Data

US 2020/0008557 A1 Jan. 9, 2020

(30) Foreign Application Priority Data

Mar. 9, 2017 (KR) ..... 10-2017-0030013

(51) Int. Cl.

| | |
|---|---|
| ***A45D 34/04*** | (2006.01) |
| ***B05B 11/00*** | (2006.01) |
| *A45D 34/00* | (2006.01) |
| *B65D 83/06* | (2006.01) |

(52) U.S. Cl.

CPC ..... *A45D 34/04* (2013.01); *B05B 11/0037* (2013.01); *B05B 11/3052* (2013.01); *A45D 2034/002* (2013.01); *A45D 2200/055* (2013.01); *A45D 2200/056* (2013.01); *B65D 83/06* (2013.01)

(58) Field of Classification Search

CPC ..... A45D 34/04; A45D 2034/002; A45D 2200/055–056; B05B 11/0037; B05B 11/3052; B65D 83/06; B65D 83/34; B65D 83/345

USPC ..... 222/321.1–321.9, 385

See application file for complete search history.

(56) References Cited

U.S. PATENT DOCUMENTS 4,050,860 A * 9/1977 Beres ..... B05B 11/3023 417/444
5,217,148 A * 6/1993 Cater ..... B05B 11/0037 222/321.2
5,638,996 A * 6/1997 Montaner ..... B05B 11/3025 222/321.2

(Continued)

FOREIGN PATENT DOCUMENTS

JP 1999267559 A 10/1999
JP 2019548931 A 9/2019

(Continued)

*Primary Examiner* — Paul R Durand
*Assistant Examiner* — Andrew P Bainbridge
(74) *Attorney, Agent, or Firm* — John K. Park; Park Law Firm

(57) ABSTRACT

The present invention disclosed herein relates to a bead discharge pump container, in particular, a bead discharge pump container, which has a cylinder-type pump structure having a check valve and designed by changing a check valve structure, a piton rod structure, a gap between a piston rod and a seal cap, and the like such that the bead contents are easily discharged without being burst.

2 Claims, 5 Drawing Sheets

(56) References Cited

U.S. PATENT DOCUMENTS

| | | | | |
|---|---|---|---|---|
| 6,045,008 | A * | 4/2000 | Gonzalez Fernandez | B05B 11/306 222/153.13 |
| 6,230,942 | B1 * | 5/2001 | Kuo | B05B 11/3001 222/321.9 |
| 6,592,009 | B2 * | 7/2003 | Su | B05B 11/3023 222/321.2 |
| 7,870,977 | B2 * | 1/2011 | Pietrowski | B05B 11/0078 222/321.2 |
| 8,678,241 | B2 * | 3/2014 | Wang | B05B 11/3023 222/190 |
| 10,046,348 | B2 * | 8/2018 | Brugger | A45D 34/04 |
| 2001/0011562 | A1 * | 8/2001 | Bailly | B05B 11/0056 141/2 |
| 2020/0008557 | A1 * | 1/2020 | Jung | B65D 83/04 |

FOREIGN PATENT DOCUMENTS

| | | | |
|---|---|---|---|
| KR | 20-0318834 | Y1 | 7/2003 |
| KR | 10-0737283 | B1 | 7/2007 |
| KR | 20-2009-0003811 | U | 4/2009 |
| KR | 20-0464671 | Y1 | 1/2013 |
| KR | 10-1501027 | B1 | 3/2015 |

* cited by examiner

BEAD DISCHARGE PUMP CONTAINER

BACKGROUND OF THE INVENTION

The present invention disclosed herein relates to a bead discharge pump container, in particular, a bead discharge pump container, which has a cylinder-type pump structure having a check valve and designed by changing a check valve structure, a piton rod structure, a gap between a piston rod and a seal cap, and the like such that the bead contents are easily discharged without being burst.

Generally, among functional cosmetics, there are granule type cosmetics containing capsules where other ingredients are contained as a main component. In case of having to mix two incompatible ingredients such as vitamin A or vitamin C, or to add materials that tend to be spoiled easily if they are put together, these granule type cosmetics have specific ingredients which are put in capsules and mixed with basic ingredients of cosmetics.

A container containing encapsulated granule contents as in the above is disclosed in the registered Korean utility model No. 20-0180852. (Hereafter called as the registered utility model)

The registered utility model relates to a container, the container comprises a container body receiving encapsulated granule contents, a pump which is attached to an outlet part of the container body and thereby discharges the contents, a head having a nozzle, and a discharging passage connecting the outside through the pump and the head from the container body, wherein a net is installed to the passage for pulverize the encapsulated granule contents.

The registered utility model is configured in a way that granule type cosmetics pass through and burst to be mixed with main ingredients and then discharged when the contents are discharged. However, a user cannot confirm whether the granule type cosmetics are burstd and mixed during the discharging process of the contents or the granule type cosmetics are discharged after being mixed with main ingredients already burst. Hence, there arises a problem that the user cannot trust effectiveness of the product for fear that the contents thereof should be spoiled.

Meanwhile, in case cosmetics are discharged according to a pumping operation through a pumping structure such as the registered utility model, it is possible that there arises a situation that a part of granular cosmetics is burst while passing through a check valve, e.g. a ball valve installed inside a cylinder of a pump. Due to this, reliability of the cosmetic products for their effectiveness may be degraded, and there arises a problem that burst granules can be cumulated at the pump and cause the malfunction of the pump as well.

To solve the problems in the above, a structure of storing granule-type cosmetics which are not easily breakable and discharging the granule-type cosmetics. However, when a pump performs pumping operation, the granule-type cosmetics get trapped in the check valve and the piston rod and others, makes the pumping operation unsmooth. Therefore, there arise a problem that the cylinder-type pump structure with a check valve cannot be applied to granule-type cosmetics.

Accordingly, there increases a demand for a pumping structure which makes it possible to discharge granule type cosmetics with granules not being burst, such that a user can mix and use cosmetics while confirming the intactness of granule type cosmetics directly with her own eyes.

SUMMARY OF THE INVENTION

The present invention is devised to solve said problems above, and its goal is to provide a bead discharge pump container, which has a cylinder-type pump structure having a check valve and designed by changing a check valve structure, a piton rod structure, a gap between a piston rod and a seal cap, and the like such that the bead contents are easily discharged without bursting.

To solve such problems described in the above, a bead discharge pump container according to the present invention comprises: a container body storing liquid contents and bead contents; a pumping member disposed at the upper portion of the container body and discharging the liquid contents and the bead contents stored in the container body by pumping operation; and a button unit coupled to the upper portion of the pumping member and inducing the pumping operation of the pumping member according to the presence and absence of user's pressurization, wherein the pumping member further comprises a cylinder having a content absorption hole at the center portion of the lower end thereof; a check valve installed at the inner side of the cylinder and opening and closing the content absorption hole; a stem whose one side is at the inner side of the button unit and whose other side placed at the inner side of the cylinder and ascending and descending according to the presence and absence of pressurization of the button unit; a piston rod coupled to the lower portion of the stem and formed with a content inflow hole at the outer circumferential surface of the lower portion thereof and formed with a content outflow hole at the upper end thereof; and a seal cap coupled as encasing the outer circumferential surface of the piston rod at the lower portion of the piston rod and opening and closing the content inflow hole and moving while being closely contacted to the inner wall of the cylinder.

It is characterized in that the check valve has a space (S1) separated from the content absorption hole is either the same with or bigger than the size of bead contents when the content absorption hole opens, and the content inflow hole of the piston rod is smaller the content outflow hole but bigger than two times of the diameter of the bead contents, and the size of a space that a securing protrusion of the stem is separated from the upper end of the seal cap when the pumping operation of the pumping member is not performed is bigger than the diameter of the bead contents.

Furthermore, it is characterized in that the check valve comprises a valve body, an opening and closing plate extending to the center portion of the valve body and opening and closing the content absorption hole, and a plurality of supports extending from the inner circumferential surface of the valve body and supporting the opening and closing plate, wherein the length of the supports is calculated by the equation in the following:

$$c^2=a^2+b^2$$

(a: length of the opening and closing plate, b: ascending height of the opening and closing plate (the diameter of bead contents), c: length of the support)

Furthermore, it is characterized in that the amount of bead contents mixed is less than 30% of the amount of liquid contents mixed.

As described above, the present invention provides a cylinder-type pump structure having a check valve, wherein structures of a check valve and a piton rod, and the pump structure design changing a gap between a piston rod and a seal cap makes it possible to discharge bead contents without being burst.

DETAILED DESCRIPTION OF PREFERRED EMBODIMENTS

Figure 1:
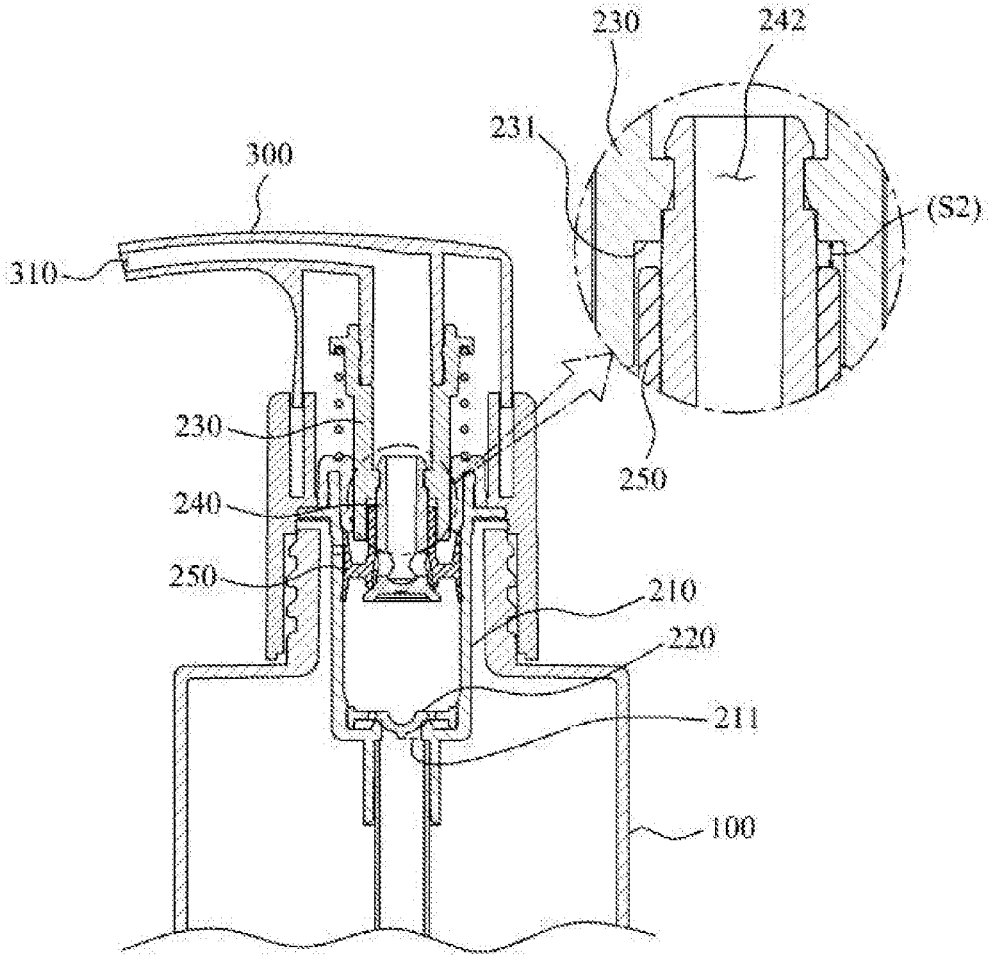
FIG. 1 is an explanatory drawing illustrating a separated space between the protrusion of the stem and the upper end of the seal cap of the bead discharge pump container according to an exemplary embodiment of the present invention.

Hereinafter, exemplary embodiments of the present invention will be described in detail with reference to the accompanying drawings. The same reference numerals provided in the drawings indicate the same members.

Figure 2:
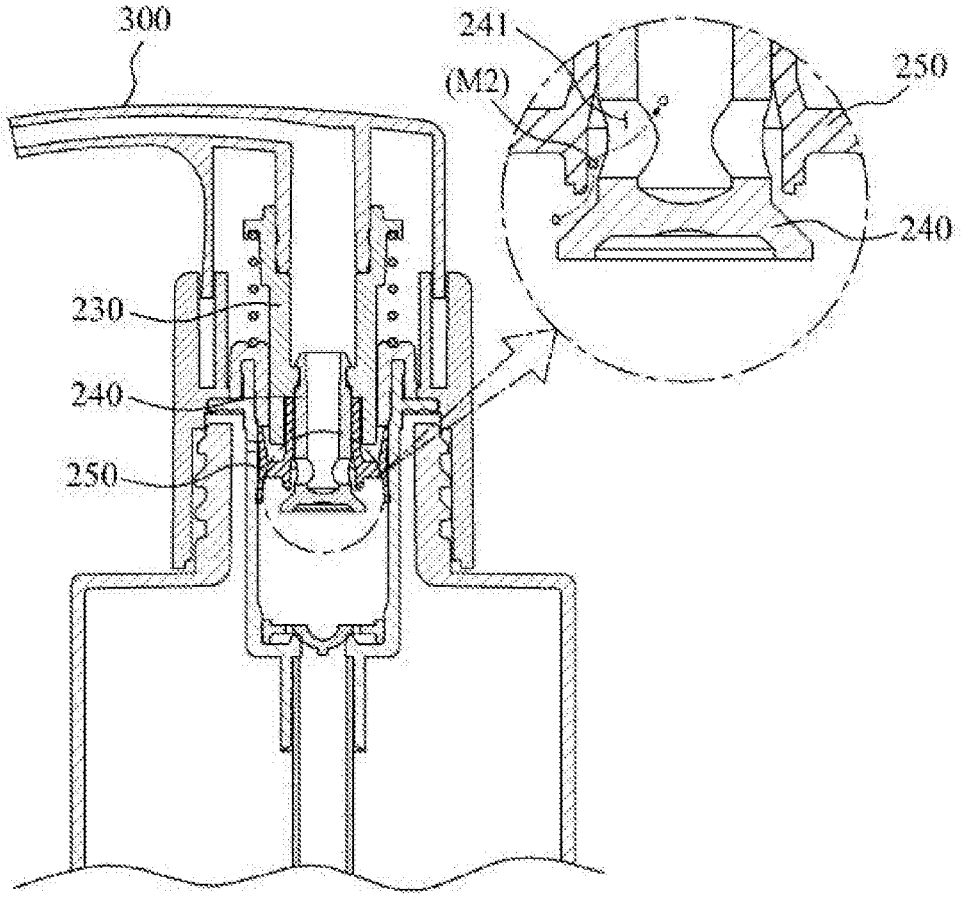
FIG. 2 is an explanatory drawing illustrating an opened state of the content inflow hole by the descent of the piston rod of the bead discharge pump container according to an exemplary embodiment of the present invention.

FIG. 1 is an explanatory drawing illustrating a separated space between the protrusion of the stem and the upper end of the seal cap of the bead discharge pump container according to an exemplary embodiment of the present invention. FIG. 2 is an explanatory drawing illustrating an opened state of the content inflow hole by the descent of the piston rod of the bead discharge pump container according to an exemplary embodiment of the present invention.

Figure 3:
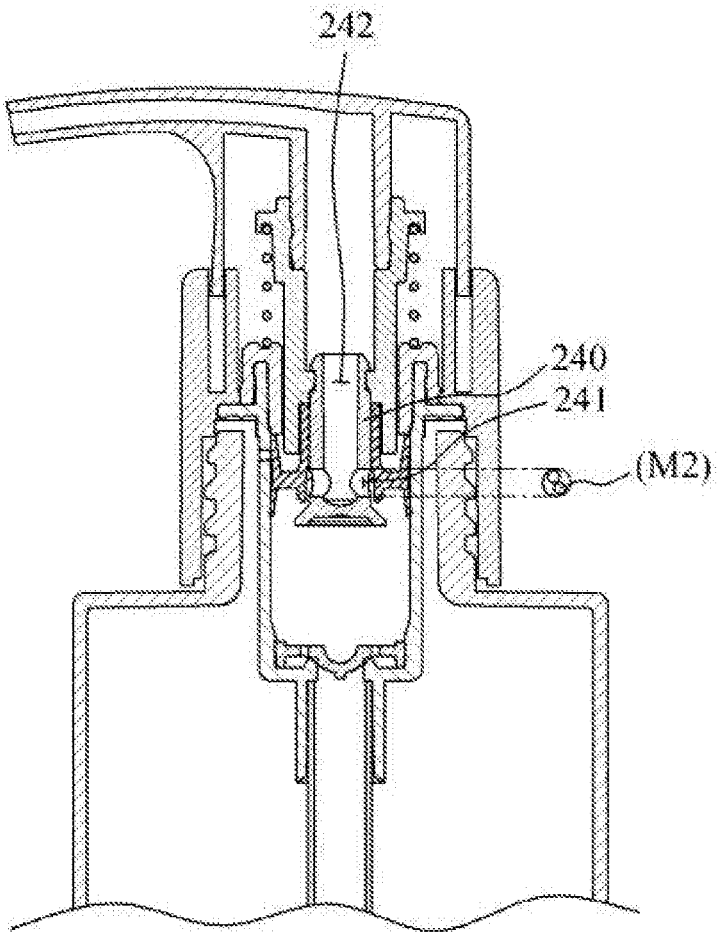
FIG. 3 is an explanatory drawing illustrating a size of the content inflow hole of the piston rod of the bead discharge pump container according to an exemplary embodiment of the present invention.
Figure 4:
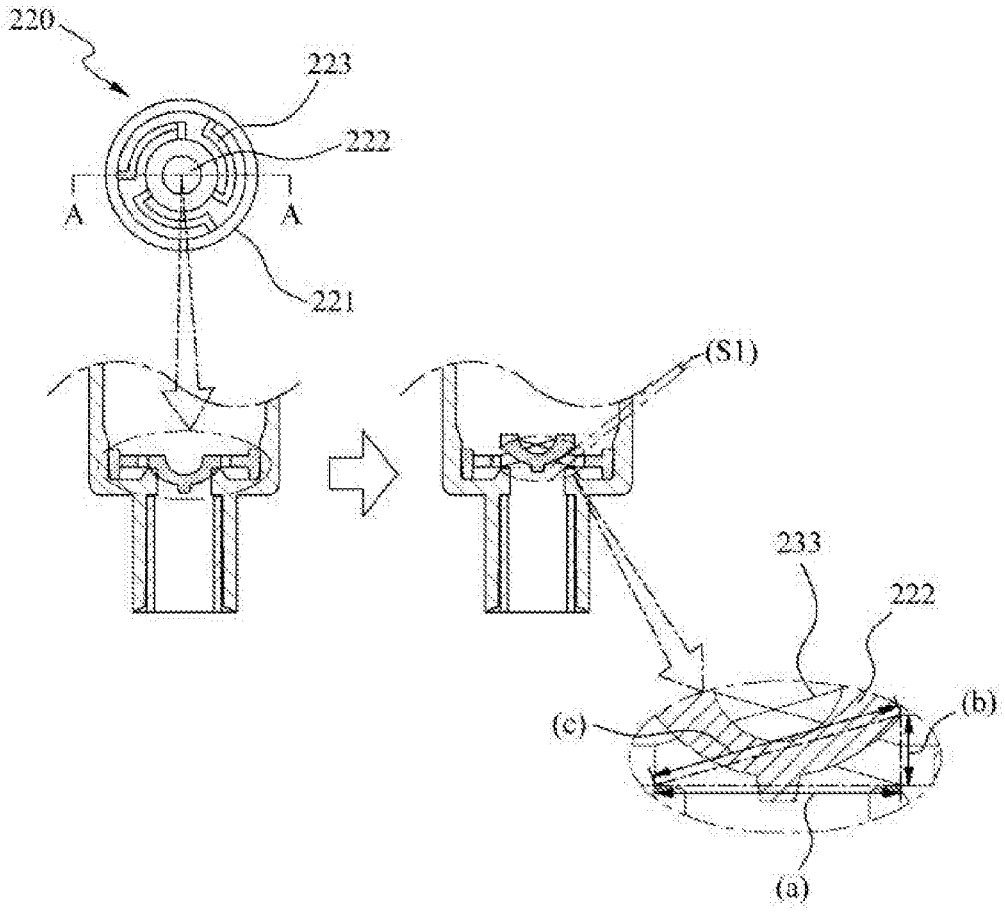
FIG. 4 is an explanatory drawing illustrating a structure of the check valve of the bead discharge pump container according to an exemplary embodiment of the present invention.
Figure 5:
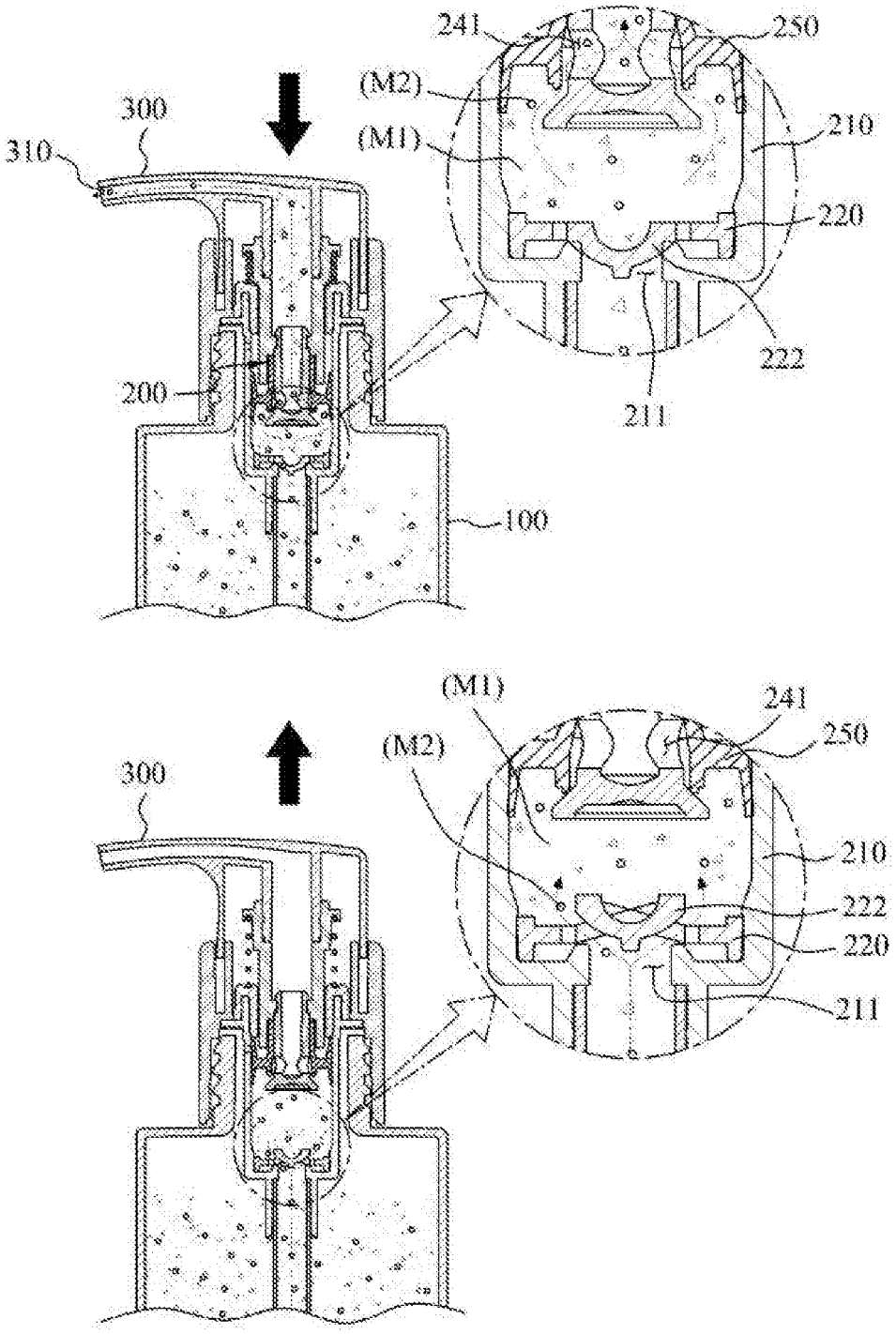
FIG. 5 is an explanatory drawing illustrating a content discharging process of the bead discharge pump container according to an exemplary embodiment of the present invention.

FIG. 3 is an explanatory drawing illustrating a size of the content inflow hole of the piston rod of the bead discharge pump container according to an exemplary embodiment of the present invention. FIG. 4 is an explanatory drawing illustrating a structure of the check valve of the bead discharge pump container according to an exemplary embodiment of the present invention. FIG. 5 is an explanatory drawing illustrating a content discharging process of the bead discharge pump container according to an exemplary embodiment of the present invention.

Referring to FIGS. 1 to 5, a bead discharge pump container according to an exemplary embodiment of the present invention includes a container body 100, a pumping member 200, and a button unit 300.

The container body 100 stores liquid contents M1 and bead contents M2, wherein the bead contents M2 are composed of granules of the size less than 1 mm and will be used for removing dead skin cells mainly from user's face or body.

High proportion of the bead contents M2 may cause unsmooth pumping operation of the pumping member 200 and thereby contents are not smoothly discharged. Therefore, it is preferable that the amount of bead contents M2 mixed is less than 30% of the amount of liquid contents mixed.

The pumping member 200 comprises: a cylinder 210, disposed at the upper portion of the container body 100 and discharging liquid contents M1 and bead contents M2 stored in the container body 100 by pumping operation, further having a content absorption hole 211 at the center portion of the lower end thereof; a check valve 220 installed at the inner side of the cylinder 210 and opening and closing the content absorption hole 211; a stem 230 whose one side is at the inner side of the button unit 300 and whose other side placed at the inner side of the cylinder 210 and ascending and descending according to the presence and absence of pressurization of the button unit 300; a piston rod 240 coupled to the lower portion of the stem 230 and formed with a content inflow hole 241 at the outer circumferential surface of the lower portion thereof and formed with a content outflow hole 242 at the upper end thereof; and a seal cap 250 coupled as encasing the outer circumferential surface of the piston rod 240 at the lower portion of the piston rod 240 and opening and closing the content inflow hole 241 and moving while being closely contacted to the inner wall of the cylinder 210.

In the present invention, the pumping member 200 is characterized to be configured to discharge, without breaking, the bead contents M2. As illustrated in FIG. 1 and FIG. 2, in a state of the pumping member 200 not performing pumping operation, that is, in a state of the button unit 300 not being pressurized, a securing protrusion 231 of the stem 230 is separated from the upper end of the seal cap 250. At this moment, if the button unit 300 is pressurized, the piston rod 240 descends as much a height as a space S2 that the securing protrusion 231 of the stem 230 separates from the upper end of the seal cap 250, and gets separated from the seal cap 250, such that the content inflow hole 241 of the piston rod 240 gets open.

As in the above, when the content inflow hole 241 of the piston rod 240 gets open, the bead contents M2 flow in through the content inflow hole 241. In order the bead contents M2 can be prevented from being burst while flowing in through a separated space of the piston rod 240, it is preferable that the size of a space S2 that the securing protrusion 231 of the stem 230 is separated from the upper end of the seal cap 250 should be bigger than the diameter of the bead contents M2.

Meanwhile, if the size of the content inflow hole 241 of the piston rod 240 is the same with or a little bigger than the size of each of bead contents M2, the bead contents M2 cannot flow in smoothly and irregular pumping operation may be performed. Accordingly, as illustrated in FIG. 3, it is preferable that the content inflow hole 241 should be more than two times bigger than the diameter of the bead contents M2.

The bigger the content inflow hole 241 is, the more smoothly the bead contents M2 flow in, and the malfunction of the pumping member 200 can be prevented, but according to the structure of the pumping member 200, the content inflow hole 241 should be smaller then the content outflow hole 242.

Meanwhile, the check valve 220 comprises: a valve body 221 which is secured at the lower end of the inner side of the cylinder 210 and fixes the check valve 220 to the cylinder 210; an opening and closing plate 222 which extends to the center portion of the valve body 221 through a plurality of supports 223 and opens and closes a content absorption hole 211; and a plurality of supports 223 which extends from the inner circumferential surface of the valve body 221 and supports the opening and closing plate 222. As illustrated in FIG. 4, it is preferable that the check valve 220 should have a space S1 separated from the content absorption hole 211 be the same with or bigger than the size of the bead contents M2 such that the bead contents M2 can move without being burst when the opening and closing plate 222 ascends and opens the content absorption hole 211.

At this moment, the longer the supports 223 are, the higher the ascent height of the opening and closing plate 222, thereby making it possible for the bead contents M2 to move smoothly. The length of the supports are calculated as the following equation:

$$c^2=a^2+b^2 \quad \text{[Equation 1]}$$

(a: length of the opening and closing plate, b: ascending height of the opening and closing plate (the diameter of bead contents), c: length of the support)

In the above equation, the ascent height 'b' of the opening and closing plate 222 can substitute the size of the diameter of the bead contents M2. Due to this, according to the size of the bead content M2, it is possible to determine the length of the support 223 which can be possible to smoothly discharge bead contents M2.

The button unit 300, which is coupled to the upper portion of the pumping member 200 and induces pumping operation of the pumping member 200 according to the presence or absence of user's pressurization, is formed with a content discharge hole 310 at one side thereof such that contents can be discharged.

Meanwhile, as illustrated in FIG. 5, if the button unit 300 is pressurized in a state that liquid contents M1 and bead contents M2 are stored in the cylinder 210, the piston rod 240 descends in a state of the seal cap 250 being fixed, then gets separated from the seal cap 250, and thereby, the content inflow hole 241 of the piston rod 240 gets open. Therefore, the liquid contents M1 and the bead contents M2 pass through the content inflow hole 241 and are discharged to the outside through the content discharge hole 310. At this moment, the opening and closing plate 222 of the check valve 220 is configured to keep closed.

Furthermore, if the button unit 300 is released from pressurization, the piston rod 240 ascends and thereby, gets closely contacted to the seal cap 250, such that the content inflow hole 241 of the piston rod 240 gets closed. At this moment, the opening and closing plate 222 of the check valve 220 ascends by the pressure change inside of the cylinder 210 and opens the content absorption hole 211, such that the liquid contents M1 and the bead contents M2 stored in the container body 100 flow into the inside of the cylinder 210.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. A bead discharge pump container, comprising:

a container body storing liquid contents and bead contents;

a pumping member disposed at the upper portion of the container body and discharging the liquid contents and the bead contents stored in the container body by pumping operation; and a button unit coupled to the upper portion of the pumping member and inducing the pumping operation of the pumping member according to the presence and absence of user s pressurization, wherein the pumping member further comprises a cylinder having a content absorption hole at the center portion of the lower end thereof; a check valve installed at the inner side of the cylinder and opening and closing the content absorption hole; a stem whose one side is at the inner side of the button unit and whose other side placed at the inner side of the cylinder and ascending and descending according to the presence and absence of pressurization of the button unit; a piston rod coupled to the lower portion of the stem and formed with a content inflow hole at the outer circumferential surface of the lower portion thereof and formed with a content outflow hole at the upper end thereof; and a seal cap coupled as encasing the outer circumferential surface of the piston rod at the lower portion of the piston rod and opening and closing the content inflow hole and moving while being closely contacted to the inner wall of the cylinder, wherein the check valve has a space (S1) separated from the content absorption hole is either the same with or bigger than the size of bead contents when the content absorption hole opens, and the content inflow hole of the piston rod is smaller the content outflow hole but bigger than two times of the diameter of the bead contents, and the size of a space that a securing protrusion of the stem is separated from the upper end of the seal cap when the pumping operation of the pumping member is not performed is bigger than the diameter of the bead contents, wherein the check valve comprises a valve body, an opening and closing plate extending to the center portion of the valve body and opening and closing the content absorption hole, and a plurality of supports extending from the inner circumferential surface of the valve body and supporting the opening and closing plate, wherein the length of the supports is calculated by the equation in the following:

$$c^2=a^2+b^2$$

(a: length of the opening and closing plate, b: ascending height of the opening and closing plate (the diameter of bead contents), c: length of the support).

2. The bead discharge pump container of claim 1, wherein the amount of bead contents mixed is less than 30% of the amount of liquid contents mixed.

* * * * *